US005509581A

United States Patent [19]

Parsons

[11] Patent Number: 5,509,581

[45] Date of Patent: Apr. 23, 1996

[54] CHEMICAL IRRITANT DISPENSER

[75] Inventor: Kevin L. Parsons, Appleton, Wis.

[73] Assignee: Armament Systems and Procedures, Appleton, Wis.

[21] Appl. No.: 287,852

[22] Filed: Aug. 9, 1994

[51] Int. Cl.[6] ..... B67D 5/33

[52] U.S. Cl. ..... 222/153.13; 222/182; 222/183; 222/192; 222/325; 222/378; 222/402.11; 222/518

[58] Field of Search ..... 222/153.01, 153.13, 222/153.14, 182, 183, 192, 325, 402.11, 402.13, 510, 518, 378, 402.1

[56] References Cited

U.S. PATENT DOCUMENTS

| | | | |
|---|---|---|---|
| 3,554,410 | 1/1971 | Chambers | 222/193 |
| 3,592,357 | 7/1971 | Welch | 222/193 |
| 3,602,399 | 8/1971 | Likman et al. | 222/153 |
| 3,672,545 | 6/1972 | Marand | 222/193 |
| 3,785,530 | 1/1974 | Riccio | 222/193 |
| 3,828,982 | 8/1974 | Steigerwald | 222/402.11 X |
| 4,044,922 | 8/1977 | Bordelon | 222/183 |
| 4,044,929 | 8/1977 | Caruso | 224/2 |
| 4,220,263 | 9/1980 | Caruso | 222/183 |
| 4,292,966 | 10/1981 | Mono et al. | 128/200.23 |
| 4,402,430 | 9/1983 | Fox et al. | 222/325 X |
| 4,434,914 | 3/1984 | Meshberg | 222/402.13 X |
| 4,449,474 | 5/1984 | Mariol | 116/2 |
| 4,588,116 | 5/1986 | Litman | 224/253 |
| 4,641,644 | 2/1987 | Andersson et al. | 239/451 X |
| 4,865,229 | 9/1989 | Schneider et al. | 222/325 |
| 4,979,649 | 12/1990 | Wescott | 222/325 X |
| 5,310,086 | 5/1994 | Julinot | 222/183 X |
| 5,366,118 | 11/1994 | Ciammitti et al. | 222/153.13 X |
| 5,392,961 | 2/1995 | Starrett | 222/153.14 X |
| 5,397,029 | 3/1995 | West | 222/153.01 X |

*Primary Examiner*—Joseph A. Kaufman
*Attorney, Agent, or Firm*—Robert C. Curfiss; Butler & Binion

[57] ABSTRACT

A chemical irritant dispenser includes an in line nozzle, chemical canister and actuator, whereby the dispenser may held in the palm of the hand with the actuator between the thumb and forefinger and the nozzle at the heel of the hand, the dispenser further including a safety lock at the actuator end, the safety lock configured to be moved between the latched and unlatched positions by an upward movement of the thumb and the actuator configured to be operated by a forward movement of the thumb, without repositioning the dispenser in the hand.

15 Claims, 2 Drawing Sheets

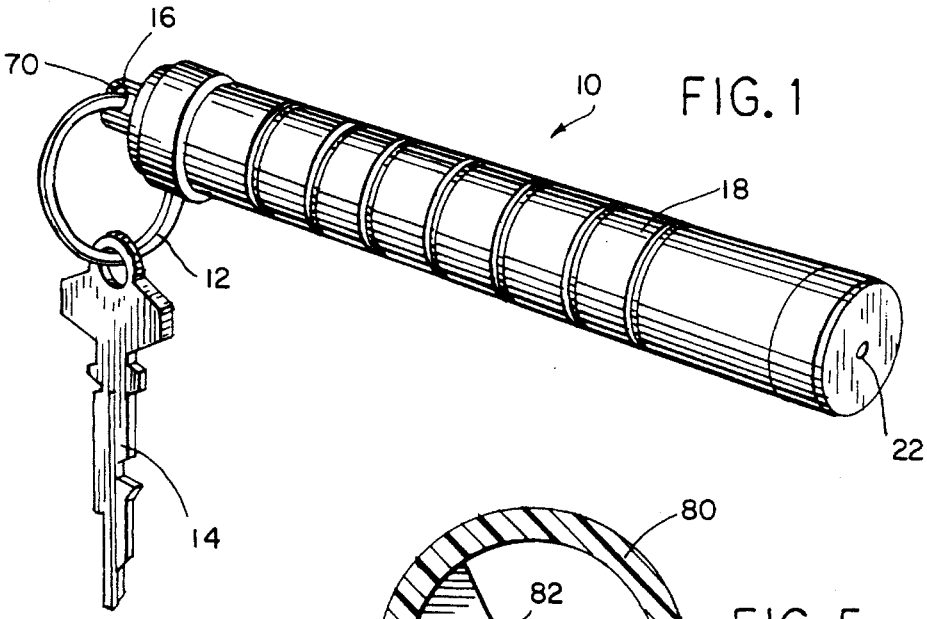
FIG. 1
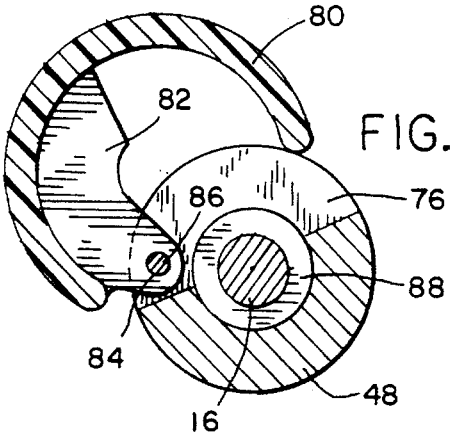
FIG. 5
FIG. 4
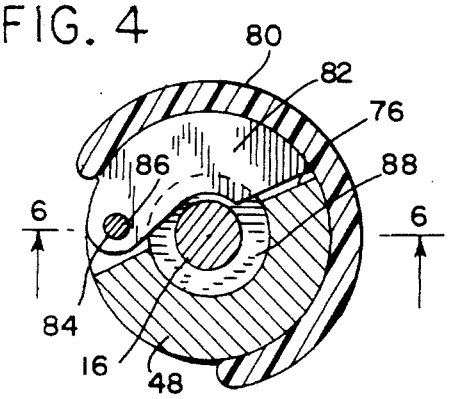
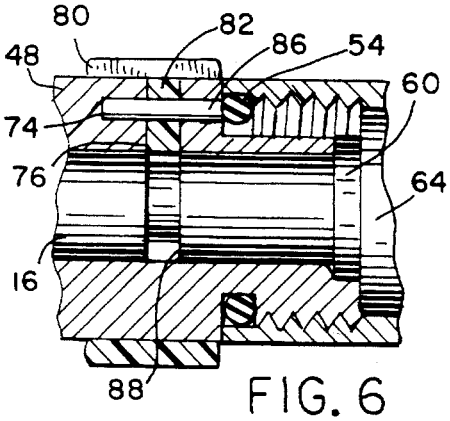
FIG. 6
FIG. 7
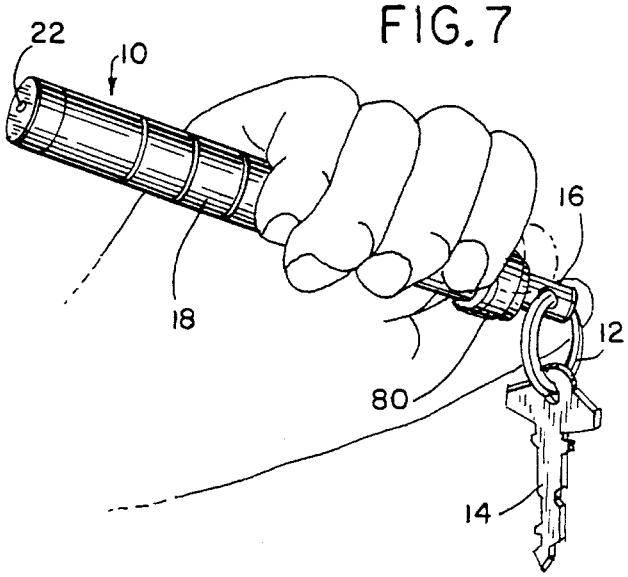

CHEMICAL IRRITANT DISPENSER

BACKGROUND OF THE INVENTION

1. Field of the Invention

The subject invention is generally related to mace dispensers for use by the general consumer and is specifically directed to a chemical irritant dispenser which is designed to be readily located and oriented for use during a crisis situation, while minimizing the likelihood of misuse.

2. Discussion of the Prior Art

Chemical irritant dispensers are well known. Typically, the dispensers contain an aerosol pepper spray or other irritant, such as by way of example, the MACE brand of chemical irritant spray manufactured by MSI. Initially, such dispensers were designed for official use by law enforcement personnel and later by certain individuals as on the job protection, such as by way of example, postal service workers, delivery men and the like. Because the dispensers were used by selected personnel, proper training minimized the chances for misuse and the specific dispensers did not necessarily take into account the ease of use and of storage. Many such dispensers are carried in holsters worn on the belt of the uniform of the wearer. An example of such a holster is shown and described in U.S. Pat. No. 4,588,116, entitled: "Holster for a Chemical Tear Gas Projector", issued to A. Litman of May 13, 1986.

Typically, prior art dispensers are fabricated from a standard aerosol canister, and are held in a vertical position when deployed, much like a handheld aerosol paint dispenser. As these dispensers gained acceptance in the general population, certain difficulties began to surface. For example, the standard aerosol canister must be properly aimed or it is possible to spray oneself with the contents. The actuator button generally includes an arrow for indicating the direction of spray. While satisfactory in many applications, the chemical irritant dispensers are typically used under stress and the requirement for conscientious aiming is a significant drawback. A number of devices have been developed to deal with this issue, see for example U.S. Pat. No. 3,602,399, entitled: "Non-Lethal Weapon Dispenser", issued to A. Litman on Aug. 31, 1971. None of these devices has met with widespread acceptance. This is primarily due to the fact that location, aiming and firing require a concentrated thought process which eliminates the element of surprise and the ability to quickly act when under duress.

More recently, this has been dealt with by attempting to incorporate the irritant dispenser in a common implement such as a key chain or the like. Examples of such devices are shown is U.S. Pat. Nos. 4,044,922, entitled: "Protective Device", issued to L. Bordelon on Aug. 30, 1977, and 4,449,474, entitled: "Personal Security Device", issued to J. Andersson et al on Feb. 10, 1987. While such devices offer improvement over other configurations of such dispensers, they do not deal with two important issues. First, it is still necessary that the device be conscientiously aimed prior to using. Secondly, while common to provide a safety lock, it is not possible to unlatch the safety lock while holding the dispenser in an at ready position, requiring two separate actions to deploy the irritant. In order to expedite use, the lock is often left unlatched, creating a hazard of accidental release of the contents of the canister. Further, the key ring dispensers of the prior art are generally bulky and cumbersome, taking up substantial space in a purse, and not conducive to being carried on the person because of the bulky, unsightly appearance. In addition, the dispensers of the prior art still require vertical positioning during use.

There are also prior art devices adapted for carrying a typical dispenser in a holder which has additional functions such as a key ring or the like. See, for example, Caruso U.S. Pat. No. 4,220,263 which discloses a holder or a pouch for a dispenser, with a closed end of the pouch formed to support a key ring. A flexible flap closes the pouch and may be depressed to activate the dispenser. As with many prior art dispensers and holders, the Caruso device does not incorporate an adequate safety system for minimizing either accidental release or improper aiming. In addition, the key ring of Caruso is not a functional feature of the design, neither in assisting in the orientation of the canister nor as part of the protective system incorporated in the design.

Yet another disadvantage of the prior art devices is the requirement that the entire unit be replaced once the supply of chemical is exhausted. This greatly increases the cost of replacement, with the resulting reduction in acceptability to the general population.

Therefore, there remains a need for a chemical irritant dispenser which is easy to carry and conceal as part of a commonly carried implement, while being simple to use in a spontaneous manner in a crisis. It is also desirable to provide an irritant dispenser which is easy to stow with a safety lock engaged and latched, wherein the dispenser can be retrieved for use and rapidly unlatched to minimize any time delay in use.

SUMMARY OF THE INVENTION

The subject invention is directed to a chemical irritant dispenser which is accessible, easy to use, includes a safety lock which is simple to latch and unlatch, and is of a design to be easily carried on the person or in a purse or the like. The dispenser of the subject invention is adapted for use with a small aerosol dispenser of approximately 3–5 inches in length and ½ inch in outer diameter. Heretofore, it was not practical to use the small dispensers because of their fragile nature. The present invention provides a durable container for protecting such dispensers without greatly increasing the bulk of the overall device. In addition, the container permits ready and inexpensive replacement of the aerosol canister, providing a dispenser with refillable inserts or cartridges.

It is an important feature of the subject invention that the irritant can be released while holding the dispenser in a horizontal position. This permits a key ring to be held in the normal position for use as a key holder while at the same time allowing for quick implementation of the dispenser without reorienting the device prior to use. It is another important aspect of the invention that the safety lock is readily visible in such a manner that it can be quickly ascertained whether or not the lock is latched, even in poor lighting. Further, the lock may be quickly unlatched while holding the dispenser in the at ready position.

The lock is also specifically designed so that it has a tendency to self-latch when the dispenser is stowed, for example, in a purse or when carried in the waist band of clothing. The safety lock is also designed to build in a secondary action for releasing the contents, further reducing the risk of accidental release. Further, the safety lock components can be easily replaced if damaged or rendered non-functional. This reduces the likelihood that the safety will be discarded and not replaced if damaged.

An important and novel feature of the dispenser of the subject invention is the manner in which the dispenser is held during use. In the preferred embodiment, the dispenser is held in the palm of the hand with the arm upright and the thumb facing the user. The thumb is used to activate the dispenser, distinguishing it from prior art devices. The dispenser is adapted to be activated when held in a substantially horizontal position. This configuration and firing position greatly minimizes the risk of accidental misfiring and greatly reduces the likelihood that the user can accidentally release the chemical at himself. The thumb is used to release the safety and activate the device in two separate actions to further minimize the accidental activation of the device.

In the preferred embodiment of the dispenser of the subject invention, the actuator is designed to carry a typical key ring. The device is specifically designed to permit the key ring to be held in a functional position while at the same time holding the dispenser in an at ready grip. This permits rapid deployment in the event of a crisis.

It is, therefore, an object and feature of the subject invention to provide a chemical irritant dispenser suitable for use by the general public without any requirement for specialized training.

It is another object and feature of the subject invention to provide a chemical irritant dispenser wherein the safety lock is easily visible, even in poor light, and may be released while holding the dispenser in an at ready position.

It is also an object and feature of the subject invention to provide a chemical irritant dispenser in combination with a key ring wherein both the key ring and the dispenser can be held in the use position with a single grip.

It is yet another object and feature of the subject invention to provide a chemical irritant dispenser that includes a replaceable chemical cartridge and replacement components.

It is also an object and feature of the subject invention to provide a chemical irritant dispenser which is easily stowed and may be quickly retrieved and gripped in an at ready position during a crisis situation.

Other objects and features will be readily apparent from the drawings and the following detailed description of the preferred embodiments.

BRIEF DESCRIPTION OF THE DRAWINGS

FIG. 1 is a perspective view of the dispenser and key ring combination.

FIG. 4 is a sectional view taken along the line 4—4 of FIG. 3 and showing the safety lock in the latched position.

FIG. 5 is a view looking in the same direction as FIG. 4 and showing the safety lock in the unlatched position.

FIG. 6 is a fragmentary view illustrating the safety lock assembly in detail.

FIG. 7 is a perspective view showing the manner in which the preferred embodiment of the invention is held for release of the chemical irritant.

DETAILED DESCRIPTION OF THE PREFERRED EMBODIMENTS

Figure 2:
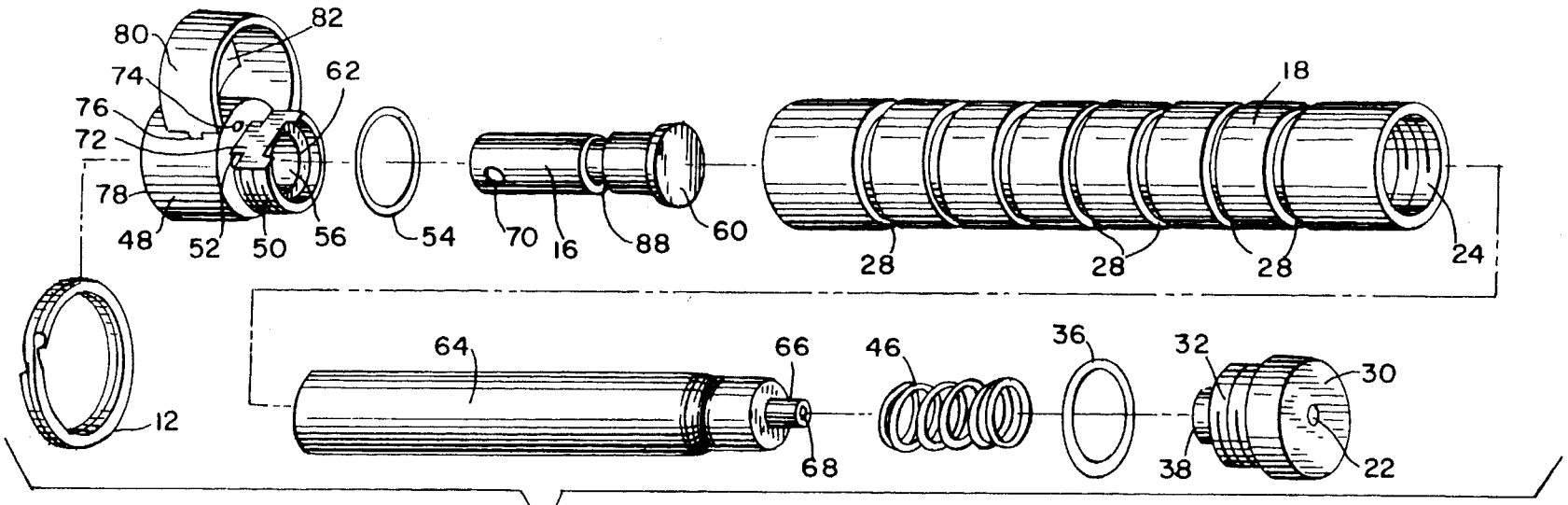
FIG. 2 is an exploded perspective view of the assembly of FIG. 1.

The preferred embodiment of the chemical irritant dispenser of the subject invention is shown in FIG. 1 and is designated by the numeral 10. As shown, the dispenser is in combination with a typical key ring 12 for holding one or more keys 14. In the preferred embodiment, the stem 16 extends outwardly from the dispenser body 18 and defines the actuator. The stem includes a through hole 70 for receiving a typical split-ring key ring 12. The nozzle 22 is in axial alignment with the stem 16 and is located at the opposite end of the dispenser body 18.

Figure 3:
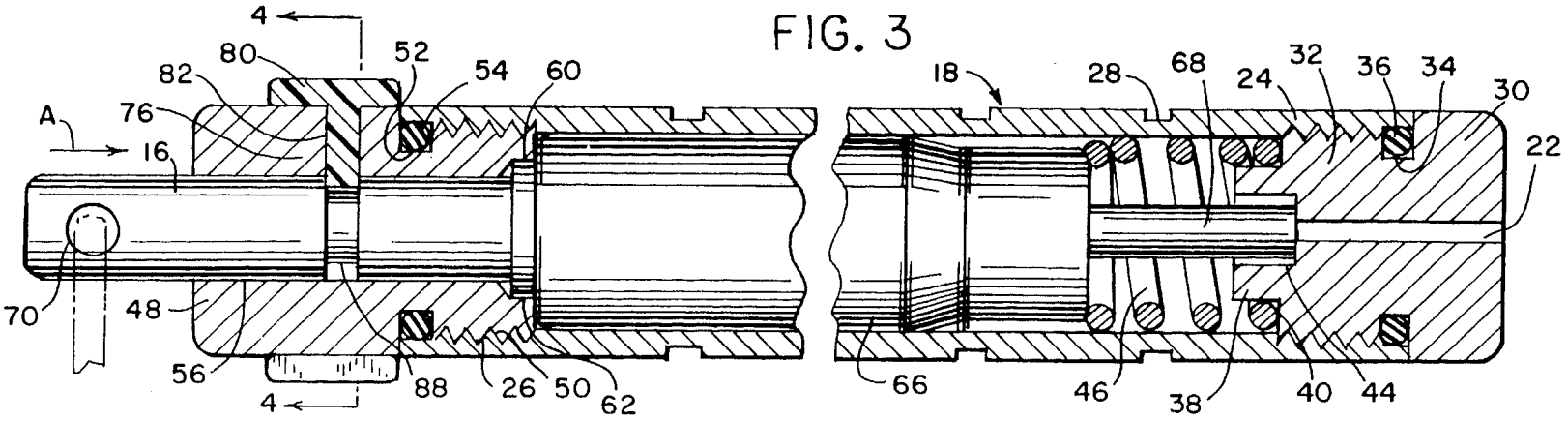
FIG. 3 is an enlarged, longitudinal cross-sectional view of the assembly of FIG. 1.

As better seen in FIGS. 2 and 3, the dispenser body 18 comprises a generally cylindrical, open-ended tube having opposite internally threaded ends 24 and 26. The external surface of the tube may be ribbed, as at 28 to provide a better gripping surface. In the preferred embodiment, the tube is made of anodized aluminum and may be finished in any of a plurality of colors. End cap 30 includes the nozzle aperture 22 and is stepped to provide external threads 32 which mate with the tube threads at 24. An annular recess is provided at 34. When assembled as shown in FIG. 3, an 0-ring is positioned in the recess 34, and is received in the outer end of the threaded end 24. This provides a resilient friction lock for maintaining the cap 30 in firm assembled relationship with the tube 18. The lower end (as drawn) of the end cap 30 includes a reduced, protruding boss 38, defining an annular channel 40 between the boss and the internal wall of tube 18. The nozzle aperture 22 is a through, axial bore terminating in an enlarged opening 44 in the boss area 38. The channel 40 defines a spring seat for the coil compression spring 46.

The opposite end cap 48 also includes a step portion having internal threads 50 for mating with the threads 26 in the tube. An annular recess 52 is provided for receiving the O-ring 54, to provide a resilient self-locking assembly when the cap 48 is tightened into tube 18 as shown in FIG. 3. The cap 48 includes a through axial bore 56 for receiving the actuator stem or pin 16. It will be noted the pin 16 includes an enlarged head 60 which is adapted to be received in the annular seat 62 in one end of the cap 48. This assures the pin cannot slip through the bore 56, once assembled.

The canister 64 is a standard small aerosol canister of approximately 3–5 inches in length and ½ inch in diameter. The canister includes a nozzle 66 which is operative in the well known manner to release the pressurized contents of the canister. Specifically, when the nozzle 66 is depressed axially toward the canister 64, a valve is opened for releasing the contents of the canister through the nozzle aperture 68.

As best shown in FIG. 3, the outer end of the nozzle 66 is received in the enlarged opening 44 of the cap 30. The spring 46 is positioned between the canister 64 and the cap 30 to normally urge the nozzle away from the cap 30. Cap 48 is then threaded into the tube 18 to hold the canister in the assembled position of FIG. 3. When the stem 16 is depressed or advanced in the direction of arrow A (FIG. 3) the canister is advanced against the spring 46 for forcing the nozzle end 66 into the canister to release the canister contents. As the contents are release through the axial opening 68 of the nozzle, they are introduced into the coaxial dispenser nozzle 22 and released.

In the preferred embodiment, a diametric key ring hole 70 is provided in the stem 16. This receives a standard split-ring key ring 12, as shown in FIG. 3. It will be noted that the key ring 12 serves as a stop for maintaining the stem 16 in the cap 48 when the cap is removed from the tube 18.

An additional feature of the configuration of the preferred embodiment is that the ends of tube 18 are identical and each cap 30 and 48 is adapted to be received in either threaded end 24 or 26, reducing both costs of manufacture and of assembly.

The safety lock of the preferred embodiment is one important aspect of the invention. As shown in FIG. 2, the threaded portion 50 of cap 48 includes a flat 72. A longitudinal bottomed hole 74 disposed radially outwardly of the flat 72. The cap 48 also includes an external channel 76 between the flat 72 and the outer end 78 of the cap. The hole 74 extends through the channel. A C-shaped partial ring 80 includes an internal, radially extending flange 82 which is adapted to be seated in the channel 76. The flange 82 includes a through hole 84 which is aligned with the hole 74 in the cap 48 when the ring 80 is properly positioned with the flange in the channel 76. As best seen in FIG. 6, a pivot pin 86 is positioned in the hole 74 and through the hole 84 of the ring, permitting the latch ring 80 to swing or pivot between the latched position of FIG. 4 and the unlatched position of FIG. 5.

As best seen in FIGS. 2 and 3, the actuator stem 16 includes an external annular channel 88. When the enlarged head 60 of the stem 16 is seated in the recess 62 of the cap 48, the channel 88 of the stem is in alignment with the channel 76 of the cap 48 and with the safety ring flange 82. As shown in FIG. 6, the pin 86 is held in position by the O-ring 54. Thus, if the safety lock breaks, it can be readily replaced simply by removing the O-ring and the pin.

In the preferred embodiment, the ring 80 is made of a resilient material such as nylon or the like and is dimensioned to snap fit over the outer periphery of the cap 48. In order to lock the dispenser in a deactivated condition, the ring 80 is snapped into the closed position of FIG. 4, with the flange 82 firmly seated in channel 86 the stem 16 (see particularly FIG. 6). This locks the stem against axial movement and precludes compression of the canister 64 into the spring 46, thereby precluding activation of the canister nozzle 68.

In order to disengage the safety lock, the ring 80 is flipped or pivoted outwardly as shown in FIG. 5, removing flange 82 from the channel 86 in stem 16, permitting axial movement of the stem into the canister 64, for advancing the canister into nozzle 66 and releasing the canister contents.

It is an important aspect of the invention that the dispenser may be held in such a manner that it is easy to use and aim. As shown in FIG. 7, it is normal to hold the elongated tube 18 in the palm of the hand with the key(s) 14 between the thumb and forefinger. This permits a key to be grasped between the thumb and forefinger in normal fashion for inserting it into a lock. In the event the dispenser is required to function, the tube body may be held in exactly the same manner. The thumb can be used to flip open the safety latch 80 and then place on the outer end of the stem to depress it and release the canister contents through the nozzle 22.

It has been found that the two deliberate actions of the thumb, first to flip open the safety and then to depress the actuator, provide additional assurance against accidental release of the chemicals. Also, the configuration of the preferred embodiment substantially minimizes the chance for accidental spraying of the user, since it would require an awkward positioning of the dispenser and the hand in order to spray oneself. In addition, the configuration of the safety lock tends to make it self locking. That is, if the dispenser is dropped into a purse or the like after use, rolling or jostling will tend to force the lock back into the closed position. Conversely, the lock is not likely to be inadvertently opened by similar motions.

It is also an important aspect of the invention that the canister cartridge may be readily replaced once spent, preserving the remainder of the dispenser assembly.

The dispenser of the present invention has proven to be a reliable, easy to use, and relatively safe chemical irritant dispenser. While specifically designed for use by the general public, it has been found to be very desirable for use by law enforcement personnel as well as by other industries where irritants are typically carried as a routine deterrent. While certain aspects and features of the invention have been described in detail herein, it will be readily understood that the invention includes all enhancements and modifications within the scope and spirit of the following claims.

What is claimed is:

1. A dispenser for a dispersible chemical in a pressurized aerosol canister having a selectively operable nozzle normally in a closed condition for retaining the pressurized chemical in the dispenser and operable to be opened for axially projecting the chemical, the dispenser comprising:

a. a housing for the aerosol canister, the housing including a dispenser nozzle in a coaxial relationship with the canister nozzle for releasing and axially dispersing the pressurized chemical from the dispenser;

b. an actuator in the housing in coaxial alignment with the canister nozzle and the dispenser nozzle, said actuator movable between a normally inactivated position and an activated position for selectively operating and opening the canister nozzle for releasing the pressurized chemical through the canister nozzle and the coaxial housing nozzle;

c. a biasing element in the housing for normally urging the actuator into the inactivated position; and d. a safety lock associated with the actuator and moveable between a latched position wherein the safety lock is engaged with the actuator for latching it in the inactivated position and an unlatched position wherein the safety lock is disengaged from the actuator, whereby the actuator is enabled to be moved against the biasing element for operating the canister nozzle.

2. The dispenser of claim 1, wherein the housing further comprises a hollow tube having opposite open ends and wherein the canister is positioned within the tube, the housing further including a first end cap for closing one end of the tube, the first end cap including a through axial hole in alignment with the canister nozzle for defining the dispenser nozzle, and a second end cap for closing the other end of the tube for maintaining the canister within the tube.

3. The dispenser of claim 2, wherein the biasing element comprises a compression spring in the housing and seated against the first end cap, the spring in direct communication with the canister for axially urging it toward the second end cap.

4. The dispenser of claim 3, wherein the second end cap includes an axial through aperture and the actuator comprises an actuator pin extending through the aperture and having opposite outer ends, the actuator pin axially movable in the aperture, one of said outer actuator pin ends being in communication with the canister.

5. The dispenser of claim 4, wherein the other of said outer actuator pin ends extends outwardly from the second end cap and is adapted to be manually engaged, whereby the actuator pin is axially moved against the force of the compression spring.

6. The dispenser of claim 5, further including a diametrically disposed through hole adjacent the other of said actuator pin ends and a key ring carried in said through hole.

7. The dispenser of claim 6, wherein the one of said actuator pin ends is enlarged for precluding passage of the actuator pin end through the through hole in the second end cap.

8. The dispenser of claim 2, wherein the second end cap includes a through hole and the actuator comprises an actuator pin extending through the through hole and axially movable relative thereto, the safety lock comprising an element mounted on the second end cap and movable between an actuator pin engaging and latched position whereby axial movement of the actuator pin is precluded and a pin releasing and unlatched position whereby the actuator pin is free to move axially relative to the end cap.

9. The dispenser of claim 8, wherein the safety lock includes a partial ring partially circumscribing the end cap and having opposite outer ends, one ring end being pivotally secured to the end cap and the other ring end being pivotable into and out of engagement with the end cap.

10. The dispenser of claim 9, the said one ring end having a through hole, the end cap further comprising a removable pivot pin extending through the through hole for pivotally mounting the ring on the end cap, whereby the ring is removed by removing the removable pivot pin.

11. The dispenser of claim 9, wherein the housing is adapted to be carried in the palm of the hand with the actuator and safety lock ring positioned between the thumb and forefinger, whereby the thumb is used for both pivoting the ring between the latched and unlatched positions and for engaging and axially advancing the actuator.

12. The dispenser of claim 9, wherein the actuator pin includes a channel extending about the periphery thereof and wherein the safety lock includes a flange adapted to enter the channel when in the latched position and to be withdrawn from the channel when in the unlatched position.

13. The dispenser of claim 2 wherein the safety lock is in the second end cap and further comprises a peripheral shoulder on the end cap, a reduced cylindrical shaft extending axially outward from the shoulder, a clearance hole in the shoulder, a split ring received on the shoulder and adapted for partially circumscribing the reduced shaft, a clearance hole in the ring, a pivot pin passing through the clearance hole in the ring and into the clearance hole in the shoulder whereby the ring is pivotable relative to the second end cap, and securing means for securing the pivot pin in the holes.

14. The dispenser of claim 13, wherein the securing means comprises a resilient O-ring adapted to be positioned over the reduced shaft and held under compression thereagainst, the O-ring adapted for engaging and holding the pivot pin in place.

15. The dispenser of claim 2, wherein the first end cap further includes a seat for positioning the canister nozzle in alignment with the dispenser nozzle.

* * * * *